US012385242B2

(12) United States Patent
Harris et al.

(10) Patent No.: US 12,385,242 B2
(45) Date of Patent: Aug. 12, 2025

(54) SYSTEMS AND METHODS FOR MODULAR SINK WITH RAPID INSTALLATION

(71) Applicant: V-T Industries Inc., Holstein, IA (US)

(72) Inventors: Thomas E. Harris, New London, WI (US); Cordell R. Burton, Storm Lake, IA (US); Joel D. Tyler, Cushing, IA (US)

(73) Assignee: V-T Industries, Inc., Holstein, IA (US)

( * ) Notice: Subject to any disclaimer, the term of this patent is extended or adjusted under 35 U.S.C. 154(b) by 0 days.

(21) Appl. No.: 17/684,885

(22) Filed: Mar. 2, 2022

(65) Prior Publication Data

US 2022/0282468 A1 Sep. 8, 2022

Related U.S. Application Data

(60) Provisional application No. 63/155,363, filed on Mar. 2, 2021.

(51) Int. Cl.
*E03C 1/33* (2006.01)
*E03C 1/182* (2006.01)

(52) U.S. Cl.
CPC ..... *E03C 1/33* (2013.01); *E03C 1/182* (2013.01)

(58) Field of Classification Search
CPC ..... E03C 1/14; E03C 1/16; E03C 1/18; E03C 1/182; A47B 77/06
USPC ..... D23/284–287, 290, 293.1
See application file for complete search history.

(56) References Cited

U.S. PATENT DOCUMENTS 2,029,802 A 2/1936 Thomas
2,505,828 A * 5/1950 Fox ..... E03C 1/33 411/965
2,721,333 A * 10/1955 Stanitz ..... A47B 77/06 4/637
D353,652 S * 12/1994 Dannenberg ..... D23/290
D558,311 S * 12/2007 Adams ..... D23/284
10,422,115 B2 * 9/2019 Chong ..... E03C 1/33
10,550,558 B2 2/2020 Cagliari et al.
(Continued)

FOREIGN PATENT DOCUMENTS

CN 204132815 U 2/2015
JP H0549520 A 3/1993
JP 2003083552 A 3/2003

OTHER PUBLICATIONS

International Search Report and Written Opinion for Application No. PCT/US2022/018495, dated Jun. 14, 2022.

*Primary Examiner* — Erin Deery
(74) *Attorney, Agent, or Firm* — Ryan T. Grace; Advent, LLP

(57) ABSTRACT

Systems and methods for rapid installation of modular sinks into cabinetry are described. In an embodiment, a sink system includes a sink basin including a rim sized and dimensioned to extend from a back surface of a countertop of the cabinet system to beyond a front surface of the countertop. At least a portion of the sink basin is sized and dimensioned to fit between a first cut extending from the back surface of the countertop to the front surface of the countertop and a second cut extending from the back surface of the countertop to the front surface of the countertop. The sink basin includes a front portion angled downward from the rim to cover at least a portion of the front surface of the countertop. The sink basin including a lip extending outwardly from a bottom portion of the front portion.

12 Claims, 8 Drawing Sheets

(56) References Cited

U.S. PATENT DOCUMENTS

| | | | | |
|---|---|---|---|---|
| 11,680,395 | B2 * | 6/2023 | Li | E03C 1/335<br>4/630 |
| 2010/0251477 | A1 * | 10/2010 | Bates | E03C 1/24<br>4/680 |
| 2012/0222212 | A1 | 9/2012 | Booth et al. | |
| 2017/0058497 | A1 | 3/2017 | Booth et al. | |

* cited by examiner

SYSTEMS AND METHODS FOR MODULAR SINK WITH RAPID INSTALLATION

CROSS-REFERENCE TO RELATED APPLICATIONS

The present application claims the benefit under 35 U.S.C. § 119(e) of U.S. Provisional Application Ser. No. 63/155,363, entitled SYSTEMS AND METHODS FOR MODULAR SINK WITH RAPID INSTALLATION, filed Mar. 2, 2021. U.S. Provisional Application Ser. No. 63/155,363 is hereby incorporated by reference in its entirety.

BACKGROUND

Sinks can include basins with water faucets mounted to the basin or in proximity thereto. The basins can be mounted to a wall, positioned on a pedestal, or supported by cabinets or cabinet systems. Installation of the basins into cabinetry can involve cutting one or more holes into the surface of the cabinets and applying a sealant between the basin and the cabinet surface.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure pertain to systems and methods for rapid installation of modular sinks into cabinetry. In one aspect, a sink system includes a sink basin including a rim sized and dimensioned to extend from a back surface of a countertop of the cabinet system to beyond a front surface of the countertop. At least a portion of the sink basin is sized and dimensioned to fit between a first cut extending from the back surface of the countertop to the front surface of the countertop and a second cut extending from the back surface of the countertop to the front surface of the countertop. The sink basin includes a front portion angled downward from the rim to cover at least a portion of the front surface of the countertop. The sink basin including a lip extending outwardly from a bottom portion of the front portion.

In one aspect, a method for installing a modular sink system into a cabinet system includes, but is not limited to, cutting a first cut into a countertop of a cabinet system, the first cut extending from a front surface of the countertop to a back surface of the countertop; cutting a second cut into the countertop, the second cut extending from the front surface of the countertop to the back surface of the countertop, the second cut spaced apart from the first cut; removing a portion of the countertop defined between the first cut and the second cut to form an aperture in the countertop; introducing a sink basin of a modular sink system into the aperture, the sink basin supported by a rim interacting with the countertop at the first cut and the second cut; and overlapping the front surface of the countertop with a front portion angled downward from the rim to cover at least a portion of the front surface of the countertop, the front portion including a lip extending outwardly from a bottom portion of the front portion to interface with a bottom surface of the countertop adjacent the front surface.

DRAWINGS

The Detailed Description is described with reference to the accompanying figures. In the figures, the use of the same reference numbers in different instances in the description and the figures may indicate similar or identical items.

DETAILED DESCRIPTION

Figure 1:
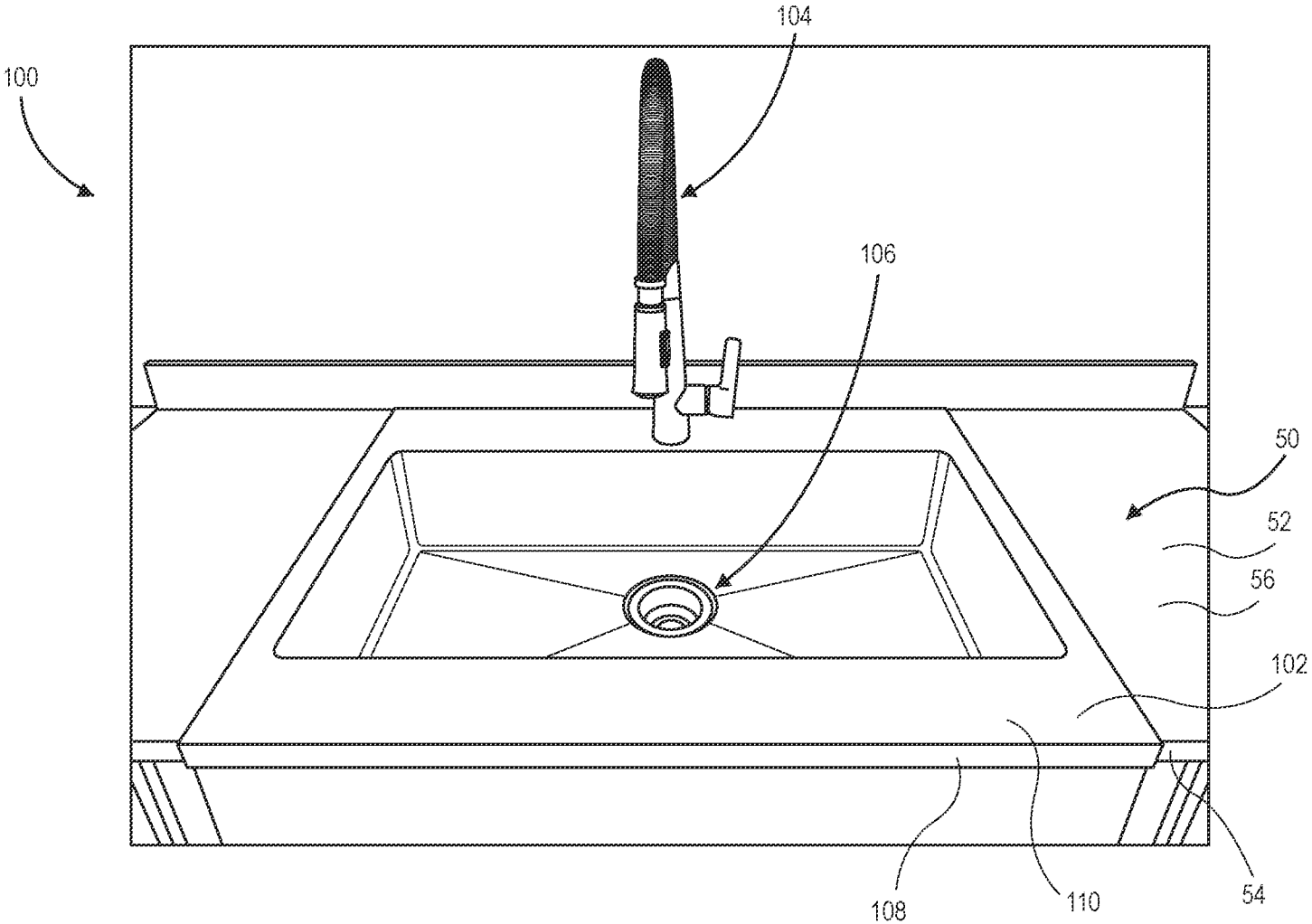
FIG. 1 is a perspective view of a modular sink system in accordance with example implementations of the present disclosure.

Features of the detailed description can be embodied in many different forms and should not be construed as limited to the combinations set forth herein; rather, these combinations are provided so that this disclosure will be thorough and complete, and will fully convey the scope. Among other things, the features of the disclosure can be embodied as modular sink systems and installation methods for modular sink systems. The following detailed description is, therefore, not to be taken in a limiting sense.

Installation of a sink basin and faucet for a sink can be a time intensive process. For installation within a cabinet system (e.g., into a countertop of the cabinet), an installation process can generally include: measuring the sink basin, marking an outline or dimensions in the countertop of the cabinet, cutting a hole into an upper surface of the cabinet system matching the outline or dimensions, setting the basin into the hole, installing faucets and other components onto the basin, applying a sealant to the underside of the basin to interact with the hole, aligning the sealed basin back into the hole, aligning and installing hardware and fasteners to secure the basin with respect to the countertop, applying a sealant to an edge of the basin along the top surface of the countertop, and the like. Many of these steps can be cumbersome during initial installation or during installation of a replacement sink into an existing countertop. For instance, a jigsaw or other tool can be utilized to cut the opening into the countertop, but such cutting can require precision handling by the operator to cut ovals, rectangles, squares, or other opening shapes. Additionally, applying sealant to the sink basin, such as on an underside of the sink basin (e.g., to interface with the top or side of the countertop) or between the edge of the sink and the top of the countertop can require precise and even application to avoid sealant from seeping, spilling, or otherwise providing a mess.

Accordingly, the present disclosure is directed, at least in part, to systems and methods for rapid installation of modular sinks into cabinetry. In an aspect, installation of a modular sink system involves two straight cuts into a cabinet countertop of a cabinet system to provide an aperture into which a sink basin is inserted. The two straight cuts can be substantially parallel cuts from a front of the cabinet countertop to the back of the cabinet countertop or from the back of the cabinet countertop to the front of the cabinet countertop to remove a section of the countertop between the two cuts. Alternatively, the cabinet system can be initially designed to include an opening extending substantially through from a front edge of the cabinet system to a back edge of the cabinet system. The modular sink system includes a front portion that interfaces with a front surface of the cabinet countertop, a false front of the cabinet system, or combinations thereof, and a side portion to overhang the top surface of the cabinet countertop to support the modular sink system on the cabinet countertop with the sink basin within the countertop interior beneath the section removed via the two cuts. The front portion defines an aperture or gap into which a portion of the countertop can rest following installation of the sink basin onto the cabinet and provides a seamless installation appearance from the front and top of the cabinet.

The modular sink system can also include adhesive strips to secure and seal the sink basin onto the cabinet countertop while ensuring proper adhesive coverage on the sink system without concern for messy adhesive application. The adhesive strips can include removable covers that can be removed just prior to installation to avoid unwanted application of adhesive to countertop surfaces. In implementations, the modular sink system includes one or more clips projecting from a bottom surface of a rim of the sink basin, where the one or more clips are configured to secure against an edge of the cabinet countertop where the straight cuts were made or where edges of the cabinet countertop that form the opening for the sink basin are located. Thus, while the modular sink system employs simple cabinet preparation for receiving the sink basin (e.g., via two cuts), the modular sink system maintains securing fitting within the cabinet system to provide a convenient and simple installation process with proper sealing against and within the cabinet.

Example Implementations

Referring to FIGS. 1-8, a modular sink system 100 is shown in accordance with example implementations of the present disclosure. The sink system 100 is configured for rapid installation into a cabinet system 50 having a countertop 52. For example, the countertop 52 can be prepared for installation of the sink system 100 through two cuts into the countertop 52, described further herein, to remove a section of the countertop therebetween, with the sink system 100 supported on top of the countertop 52 and within the cabinet system 50 beneath the removed section of countertop 52. The sink system 100 is shown generally having a sink basin 102 to engage with one or more features of the cabinet system 50, such as the countertop 52 and edges thereof, including but not limited to, front edges (e.g., facing a user of the sink basin 102), interior edges (e.g., facing towards the sink basin 102), or the like. The sink system 100 can include one or more features including, but not limited to, a faucet 104, a drain 106, and combinations thereof. The faucet 104 is configured for coupling to a water supply line or lines to provide access to water for the sink system 100. The drain 106 provides an interface between the sink system 100 and a plumbing drainpipe, a garbage disposal system, or combinations thereof. In implementations, the sink system 100 includes each of the faucet 104 and the drain 106 integrated with portions of the sink basin 102. In other implementations, the sink system 100 includes the drain 106 integrated with the sink basin 102, whereas the faucet 104 is separated from the sink basin 102 (e.g., installed separately from the sink system 100).

Figure 2:
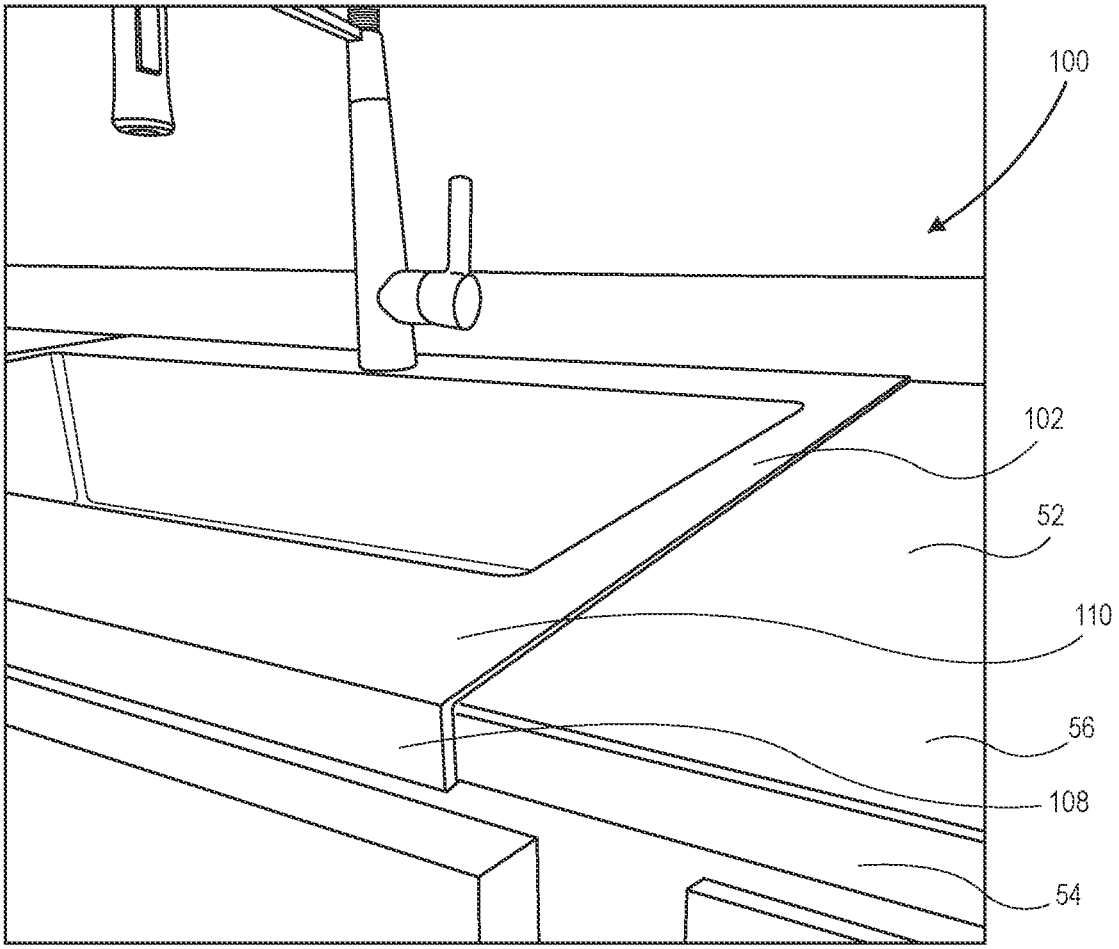
FIG. 2 is an isometric view of the modular sink system of FIG. 1, shown with a front portion interfacing with a cabinet countertop.

Referring to FIG. 2, the sink system 100 is shown with the sink basin 102 including a front portion 108 that interfaces with a front surface 54 of the countertop 52. For example, the front portion 108 can be angled downward from a rim portion 110 of the sink basin 102 to cover at least a portion of the front surface 54 of the countertop 52. In general, the sink basin 102 interfaces with the front surface 54 of the countertop 52 at opposing sides of the rim portion 110, with a gap in the front surface 54 of the countertop 52 present from removal of a section of the countertop 52 in preparation to receive the sink system 100. When the sink basin 102 is installed into cabinet system 50, the front portion 108 covers the gap present in the front surface 54 of the countertop 52. In implementations, the front portion 108 is arranged substantially perpendicularly with respect to the rim portion 110 of the sink basin 102 to match a rectangular edge of a transition between a top surface 56 of the countertop 52 and the front surface 54 of the countertop 52. Alternatively, the sink basin 102 can include one or more transition portions between the rim portion 110 and the front portion 108, such as to conform to non-rectangular edges of the countertop 52, such as for beveled edges, sloped edges, rounded edges, irregular edges, or the like.

Figure 3:
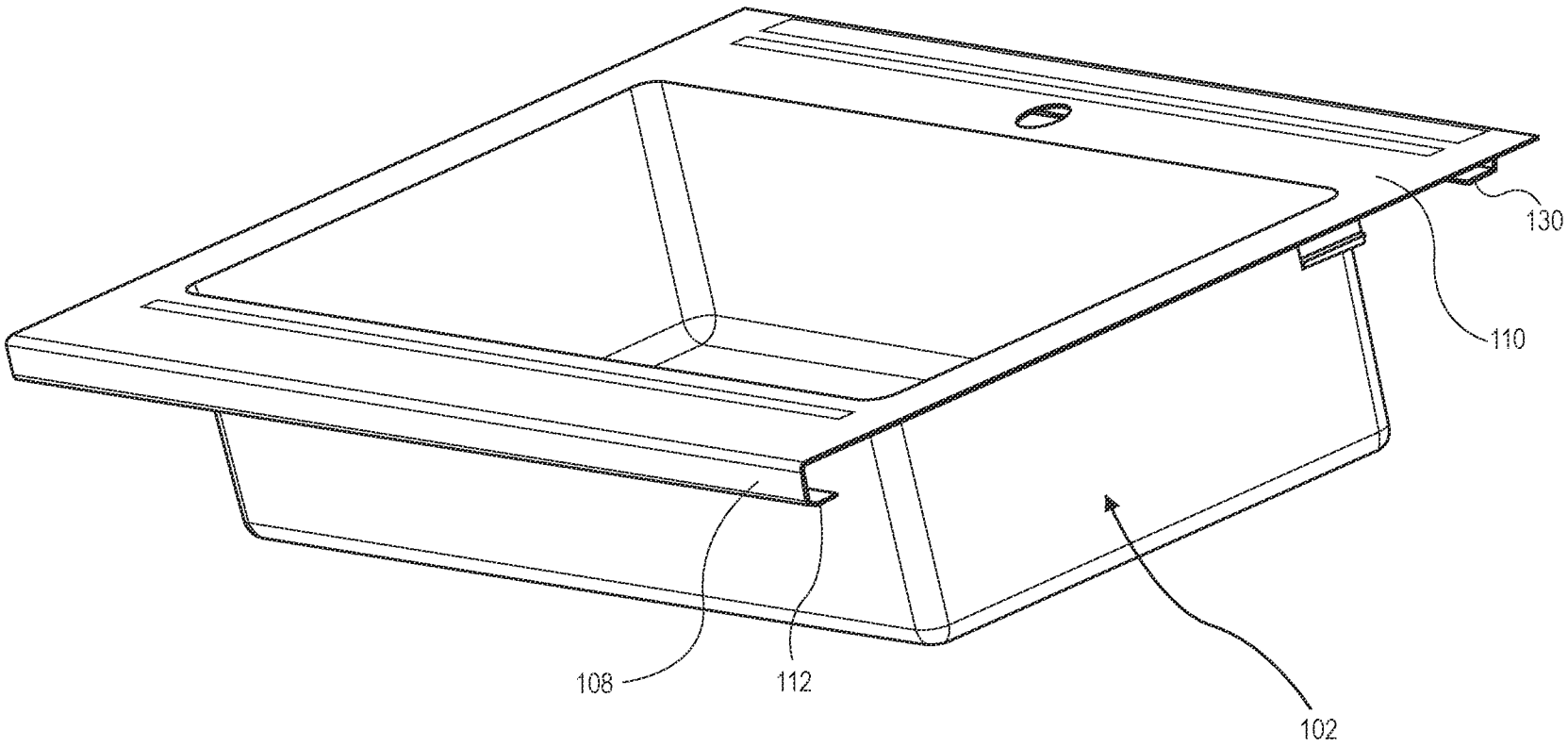
FIG. 3 is an isometric view of a sink basin of a modular sink system in accordance with example implementations of the present disclosure.
Figure 4:
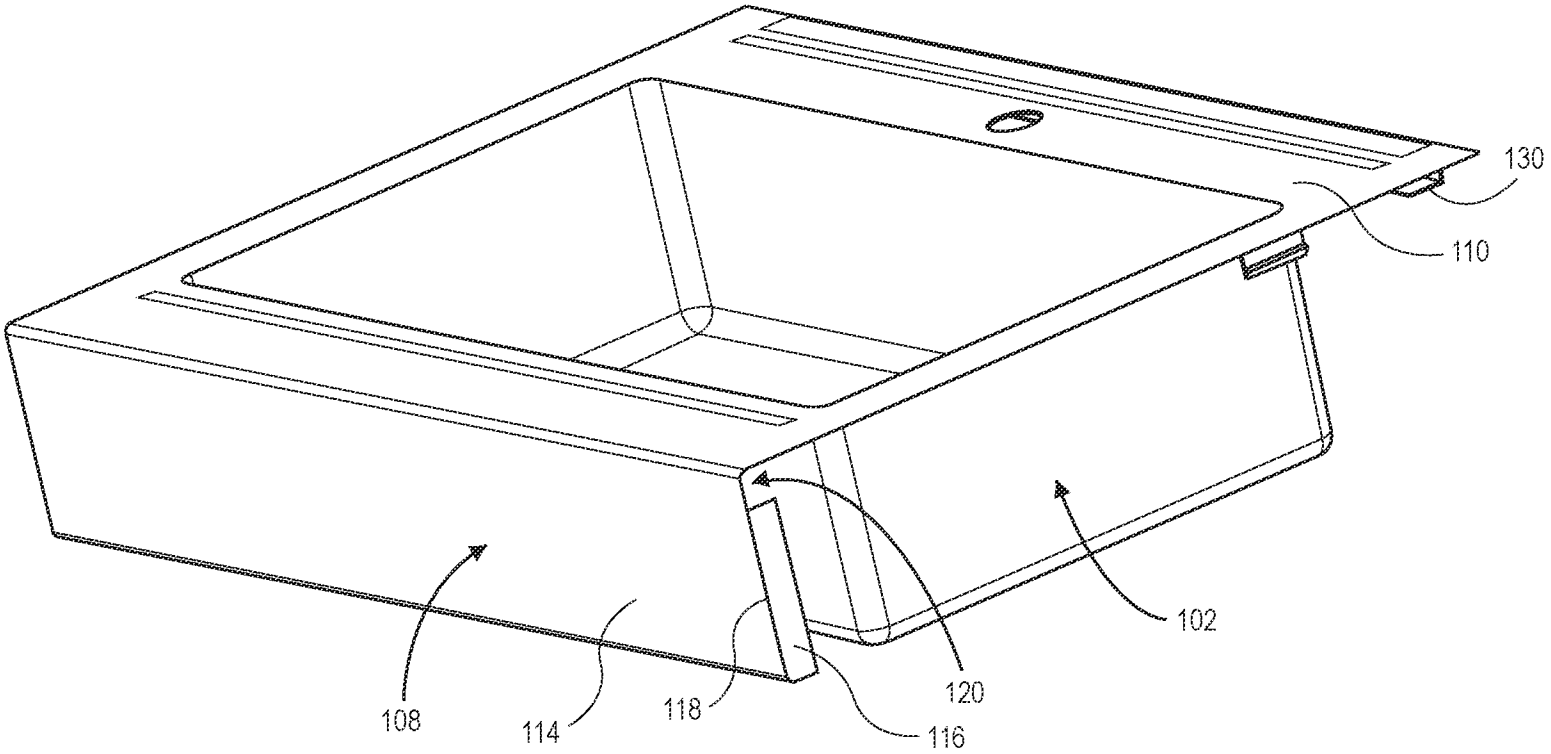
FIG. 4 is an isometric view of a farmhouse style sink basin of a modular sink system in accordance with example implementations of the present disclosure.

In implementations, an example of which is shown in FIG. 3, the front portion 108 includes a lip 112 extending from a bottom of the front portion 108 in the direction towards the sink basin 102. For instance, the front portion 108 can extend downwards from the rim portion 110 of the sink basin 102 at a top of the front portion 108 with the lip 112 extending outwards from the bottom towards the sink basin 102 and distal the top of the front portion 108. The lip 112 can interface with a bottom surface of the countertop 52 (e.g., shown in FIG. 2) to secure the sink basin 102 against the countertop 52 by preventing upward motion of the sink basin 102 due to interaction between the lip 112 and the countertop 52. For example, the lip 112, the front portion 108, and the rim portion 110 together can form an aperture into which a portion of the countertop 52 can rest following installation of the sink basin 102 onto the cabinet system 50 (e.g., resting against an interior surface defined by one or more of the lip 112, the front portion 108, and the rim portion 110).

Alternatively or additionally, the front portion 108 can include an extension 114 (e.g., shown in FIG. 4) configured to cover an upper portion of a front side of the cabinet system 50. The extension 114 can include one or more tabs 116 extending along a side edge 118 of the extension 114 in a direction towards the sink basin 102. The extension 114 and tabs 116 can provide a farmhouse-style façade for the sink system 100 without requiring removal of base portions of the cabinet system 50. For example, the extension 114 can at least substantially cover a false drawer front 58 (e.g., shown in FIG. 5) of a front side 60 of the cabinet system 50 to provide a farmhouse-style sink basin without removal of the false drawer front 58 or other portion of the front side 60 of the cabinet system 50. In implementations, the tabs 116 are spaced from the rim portion 110 by a gap 120 sized and dimensioned to receive the front surface 54 of the countertop 52 into the gap 120. For example, the gap 120 can be sized and dimensioned similar to, or the same as, the aperture formed by the lip 112, the front portion 108, and the rim portion 110 described with reference to FIG. 3.

Figure 5:
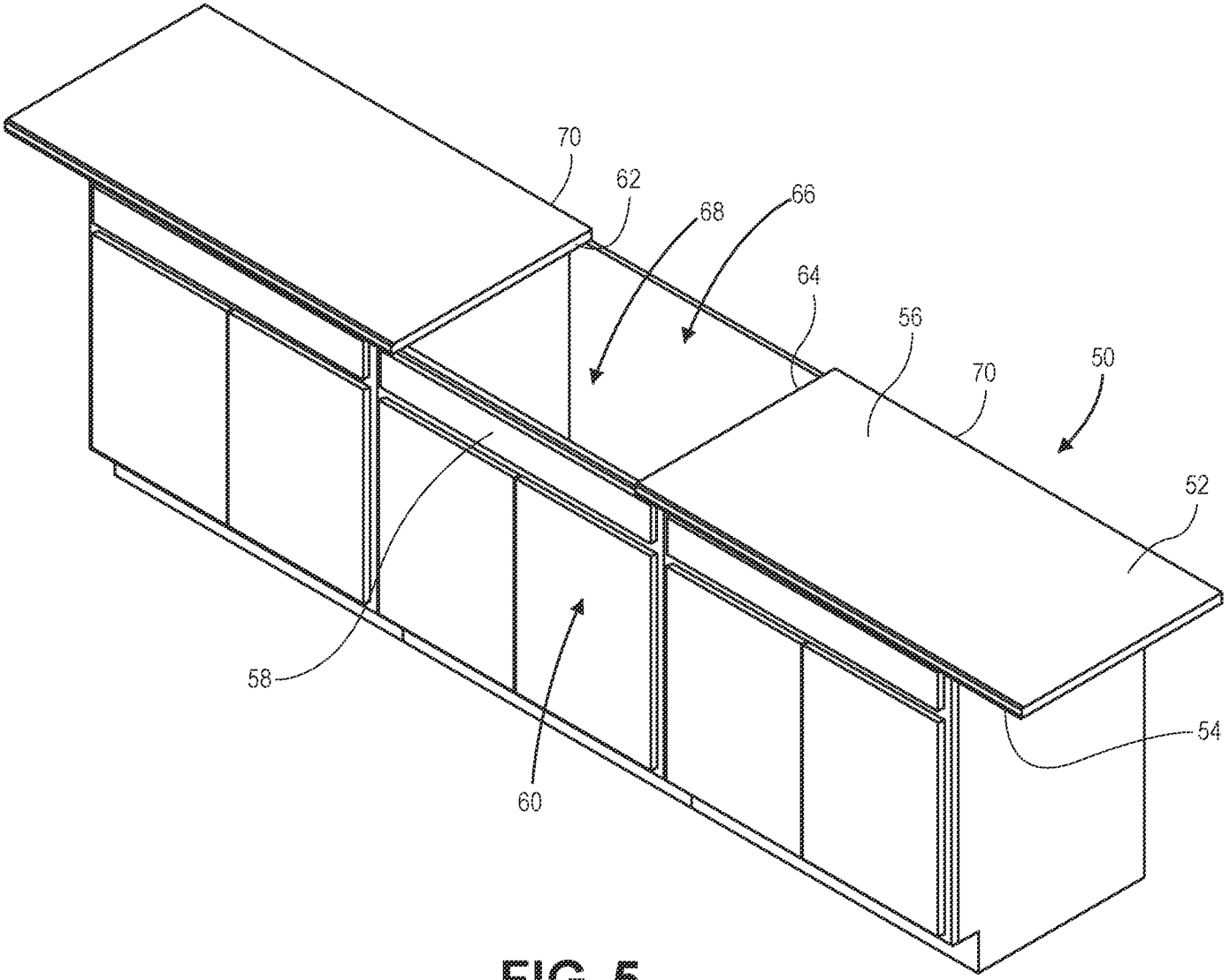
FIG. 5 is an isometric view of a cabinet system having two parallel cuts made in a cabinet countertop to prepare for installation of a modular sink system in accordance with example implementations of the present disclosure.

Referring to FIG. 5, the cabinet system 50 is shown prior to installation of the sink system 100. The cabinet system 50 is shown including a first cut 62 through the top surface 56 of the countertop 52 and a second cut 64 through the top surface 56 of the countertop 52 to form an aperture 66 through the countertop 52 to provide access to an interior region 68 of the cabinet system 50 between the first cut 62 and the second cut 64. The cuts 62, 64 can be made with any suitable carpentry or masonry cutting tool including, but not limited to, circular saws, jigsaws, reciprocating saws, carpenter saws, undercut saws, and the like. The interior region 68 can house plumbing equipment for connection to the sink system 100, such as water lines, drain lines, garbage disposal systems, the like. In implementations, the first cut 62 and the second cut 64 are substantially parallel to provide a rectangular aperture 66 into which at least a portion of the sink basin 102 fits. Alternatively or additionally, in implementations, the first cut 62 and the second cut 64 extend from the front surface 54 of the countertop 52 to a back surface 70 of the countertop 52, such that the aperture 66 displaces the entirety of the countertop 52 between the first cut 62 and the second cut 64. For example, during installation of the sink system 100 into the cabinet system 50, a user can create the aperture 66 by making two sole cuts along straight lines, without need for non-linear cuts that require significant precision of the cutting tool. Alternatively, the cabinet system 50 can be initially designed to include the aperture 66 extending substantially through from the front surface 54 of the countertop 52 to the back surface 70 of the countertop 52 without additional cuts utilized for installation of the sink system 100.

Figure 6:
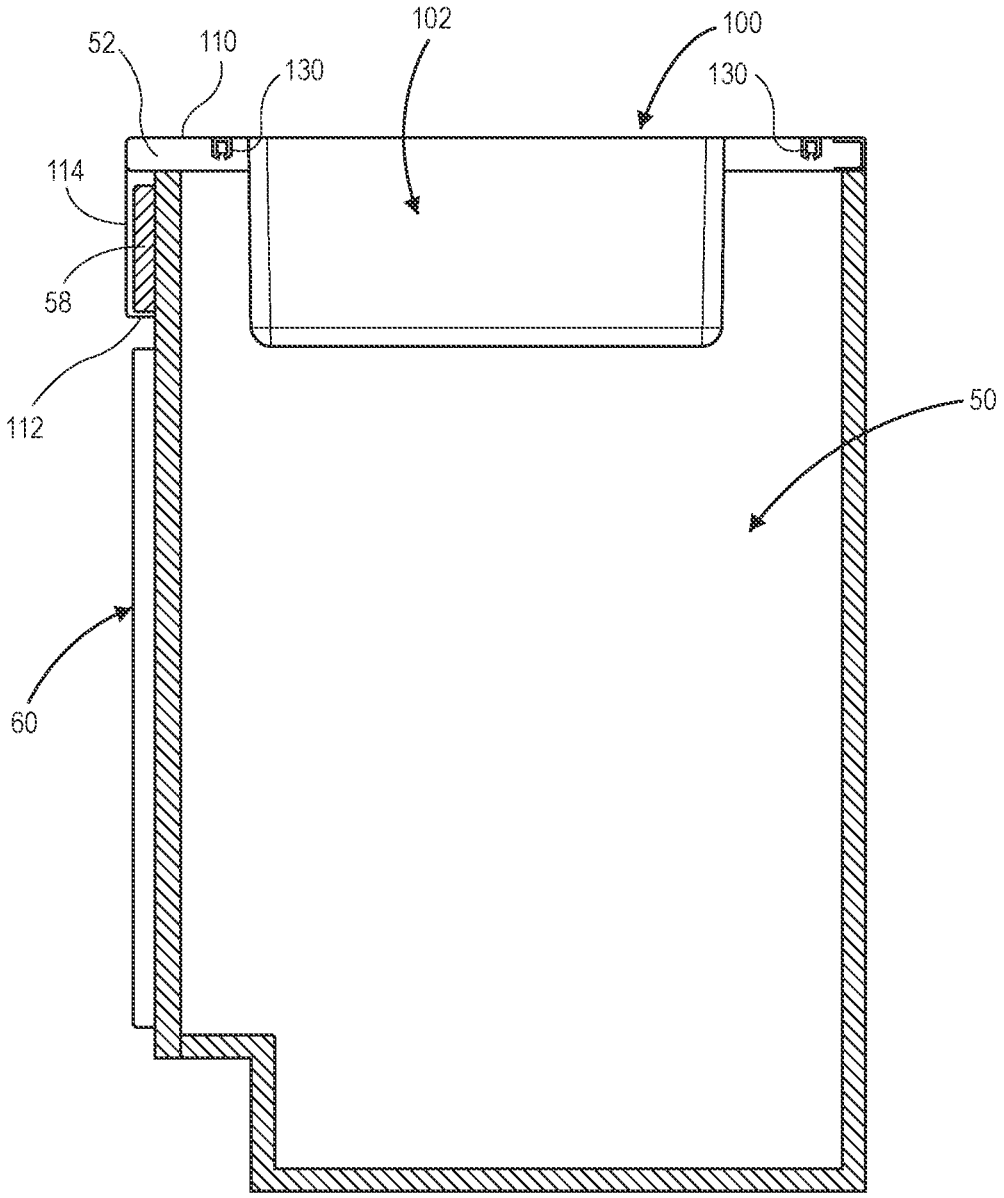
FIG. 6 is a cross-sectional side view of a modular sink system installed into a cabinet system, with a front portion of the modular sink system interfacing with a false drawer front of the cabinet system.
Figure 7:
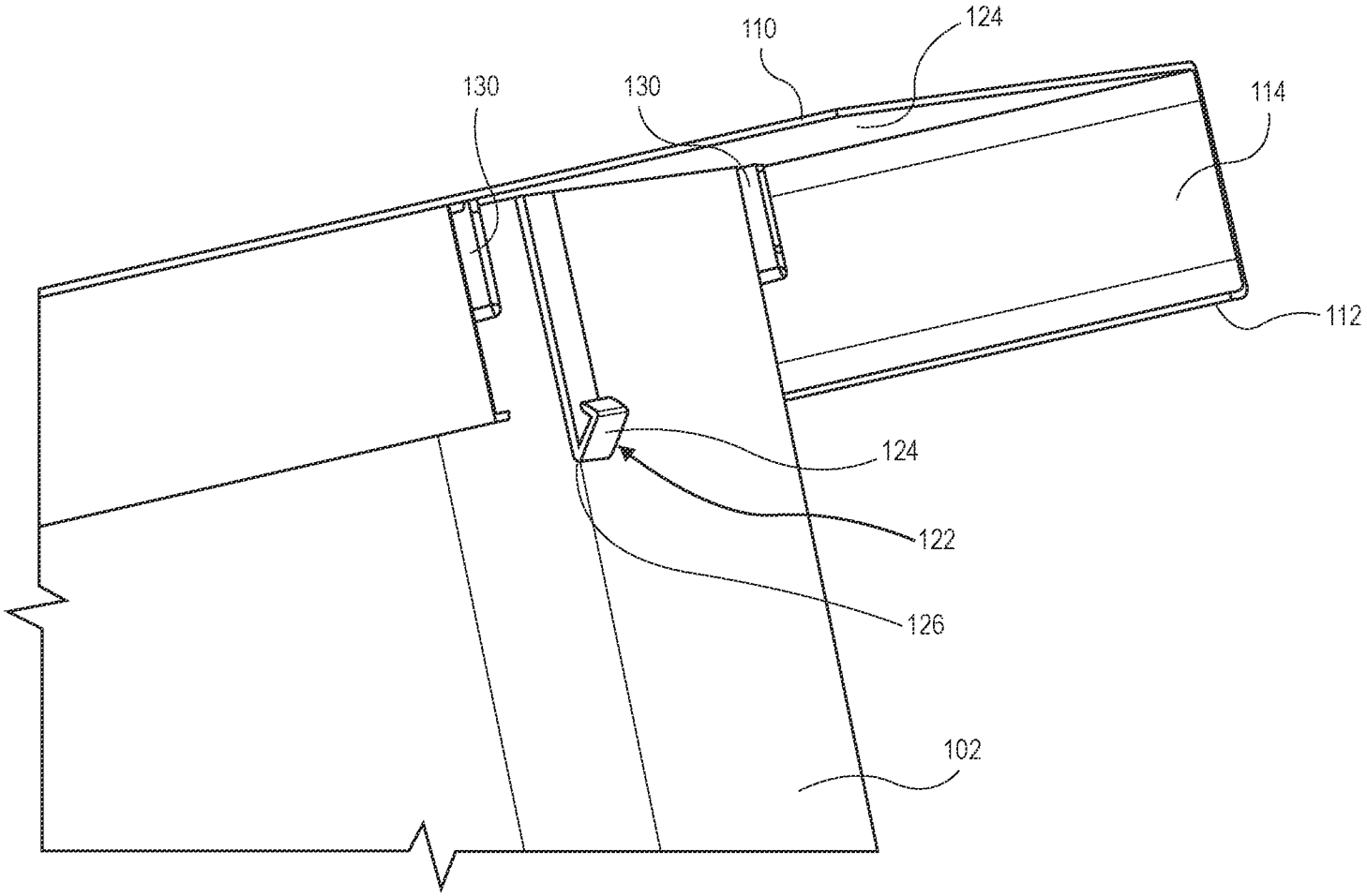
FIG. 7 is a partial perspective view of the modular sink system of FIG. 4, showing a side clip configured to interface with a cabinet countertop.
Figure 8:
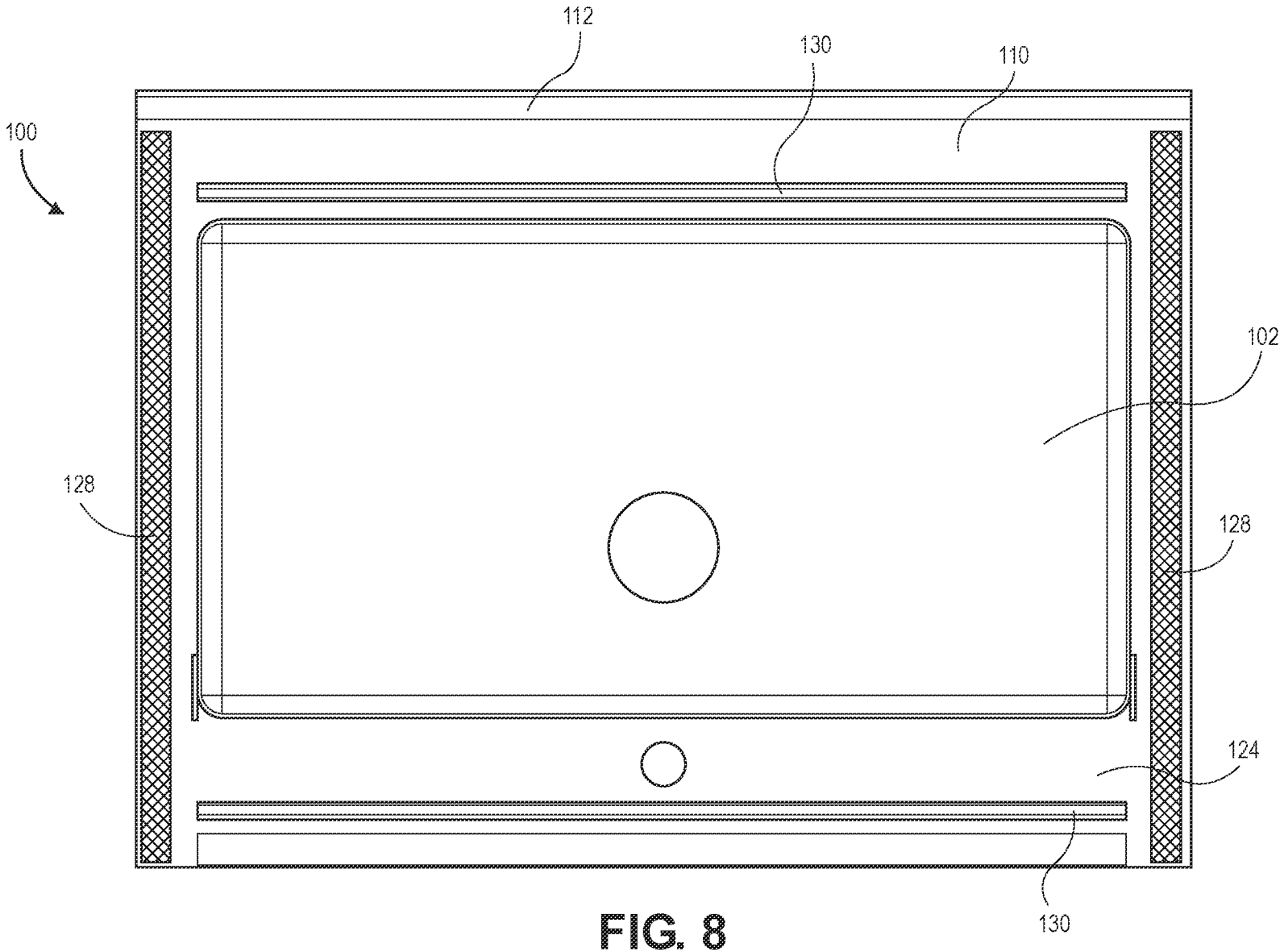
FIG. 8 is a bottom view of the modular sink system of FIG. 4, showing an adhesive configured to adhere to a top surface of a cabinet countertop.

Referring to FIG. 6, the sink system 100 is shown installed into the cabinet system 50, with the rim portion 110 supported on the countertop 52 and with the extension 114 interfacing with the front surface 54 of the countertop 52 and extending downwards past the countertop 52 to cover the false drawer front 58, with the lip 112 extended along the bottom surface of the false drawer front 58. In implementations, the sink system 100 includes one or more clips 122 (e.g., shown in FIG. 7) projecting from a bottom surface 124 of the rim 110 of the sink basin 102. The one or more clips 122 facilitate securing the sink system 100 within the cabinet system 50 once installed into the aperture 66 by engaging the clips 122 against the countertop 52. For example, the clips 122 are configured to secure against an edge of the cabinet countertop 52 where the straight cuts 62 and 64 were made. In implementations, the clips 122 include an angled portion 124 that extends upwardly from a bottom portion 126 of the clips 122 to facilitate introduction of the clips 122 into the aperture 66 by pressing the angled portion 124 against the edge of the countertop 52 at the straight cut 62 or 64 and to press against the bottom surface of the countertop 52. Alternatively or additionally, the clips 122 can include the angled portion 124 or another angled portion at an intermediate portion along the portion of the clip 122 extending from the rim 110 (e.g., above the bottom portion 126). While FIG. 7 shows one clip 122, the sink system 100 is not limited to a single clip 122 on one portion of the rim 100, and the sink system 100 can include multiple clips 122 on one side of the sink basin 102, multiple clips 122 on multiple sides of the sink basin 102, and the like.

In implementations, the sink system 100 incorporates one or more adhesive materials directly on the rim 110 or other portion of the sink system 100 to provide a rapid mechanism for sealing the sink system 100 onto the countertop 52. For example, referring to FIG. 8, the sink system 100 includes adhesive strips 128 positioned on the bottom surface 124 of the sink basin 102. While the sink system 100 is shown with two adhesive strips 128 positioned at opposing sides of the bottom surface 124 of the sink basin 102, the sink system 100 is not limited to two adhesive strips 128 or to such positioning of the adhesive strips 128. For instance, the sink system 100 can include one adhesive strip 128 or more than two adhesive strips 128. In implementations, the adhesive strips 128 can include a cover configured to be peeled off to expose the adhesive, where during installation, the sink basin 102 is introduced to the aperture 66 with the cover on the adhesive strips 128. Once the sink basin 102 is positioned with respect to the countertop 52, the cover can be removed, exposing the adhesive on the adhesive strips 128 to interface with the top surface 56 of the countertop 52. Such configuration can avoid seepage of sealant or other problems experienced with introducing sealants, such as caulking materials, to the sink basin 102 during or following installation.

The sink system 100 can include support structure to facilitate placement of the sink system 100 in the cabinet system spanning across the aperture 66. For example, the sink system 100 is shown including a support bar 130 coupled to the bottom surface 124 of the sink basin 102 and extending along the width of the rim 110 to structurally support the sink system 100 as the rim 110 spans from one side of the countertop 52 to the other side of the countertop 52. The sink system 100 can include one or more support bars 130 with various orientations on the rim 110, sink basin 102, or other portion(s) of the sink system 100, where such number and arrangement of support bars 130 can depend on the partial size and shape of the sink system 100.

An example installation process for the sink system 100 can include preparing a cabinet system 50 to receive the sink basin 102 by making two cuts into the cabinet countertop 52. For example, the countertop 52 can be cut with two straight cuts (e.g., the first cut 62 and the second cut 64) to form the aperture 66 in the countertop 52. In general, the two straight cuts can be substantially parallel (e.g., within about 15 degrees relative to each other) to provide a rectangular aperture 66 through the countertop 52 upon removal of the section of countertop 52 between the cuts. For instance, removal of the section of countertop 52 between the cuts provides a gap in the front surface 54 of the countertop 52 between the first cut 62 and the second cut 64 which will be covered by the front portion 108 of the sink system 100. Such cabinet preparation avoids laborious and time-consuming process of precise sawing of various shapes through the top surface 56 of the countertop 52 (e.g., ovals, rectangles, squares, or other opening shapes) that is required for traditional sink systems. When the aperture 66 is formed in the cabinet system, a user can lower the sink system 100 onto the cabinet system 50 with the sink basin 102 being introduced to the aperture 66 and into the interior region 68 of the cabinet system 50 between the first cut 62 and the second cut 64, with the rim portion 110 resting on the top surface 56 of the countertop 52, with the front portion 108 interfacing with the front surface 54 of the countertop 52, and with the lip 112 secured against the bottom surface of the countertop 52. The sink system 100 can include the faucet 104 and the drain 106 secured to the sink basin 102 prior to installation into the cabinet system 50. Alternatively, one or more of the faucet 104 and the drain 106 can be installed onto the sink basin 102 following installation into the cabinet system 50. Once the sink basin 102 is supported by the top surface 56 of the countertop 52, the covers of the adhesive strips 128 can be removed to expose the adhesive to the top surface 56 of the countertop 52 to secure the sink system 100 with respect to the cabinet system 50.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

The invention claimed is:

1. A modular sink system for installation into a cabinet system, comprising:

a sink basin including a rim sized and dimensioned to extend from a back surface of a countertop of the cabinet system to beyond a front surface of the countertop, at least a portion of the sink basin sized and dimensioned to fit into an aperture of the cabinet system defined between a first cut extending from the back surface of the countertop to the front surface of the countertop and a second cut extending from the back surface of the countertop to the front surface of the countertop, the sink basin including a front portion angled downward from the rim to cover at least a portion of the front surface of the countertop, the sink basin including a lip extending outwardly from a bottom portion of the front portion in a direction towards the portion of the sink basin sized and dimensioned to fit between the first cut and the second cut, the lip, the front portion, and the rim forming an aperture into which the countertop can fit at each of the first cut and the second cut, the lip configured to interface with a bottom surface of the countertop to secure the sink basin against the countertop by preventing upward motion of the sink basin due to interaction between the lip and the countertop, wherein the rim extends outwardly along a plane to terminate in an edge on the plane configured to rest on each of the back surface of the countertop and the front surface of the countertop extending beyond one of the first cut and the second cut.

2. The modular sink system of claim 1, wherein the front portion includes an extension configured to cover at least a portion of the cabinet system beneath the front surface of the countertop.

3. The modular sink system of claim 2, wherein the extension includes at least one tab extending along a side edge of the extension in a direction towards the sink basin.

4. The modular sink system of claim 3, wherein the at least one tab is spaced from the rim portion by a gap.

5. The module sink system of claim 4, wherein the gap is sized and dimensioned to receive the front surface of the countertop.

6. The modular sink system of claim 1, wherein the rim includes a clip projecting from a bottom surface of the rim, the clip configured to interface with the countertop at one of the first cut or the second cut.

7. The modular sink system of claim 6, wherein the clip includes an angled portion extending upwardly from a portion of the clip, the angled portion configured to interface with an edge of the countertop during installation of the sink basin into the aperture of the cabinet system.

8. The modular sink system of claim 1, wherein the rim includes an adhesive strip coupled to a bottom surface of the rim.

9. The modular sink system of claim 1, further comprising a drain coupled to the sink basin.

10. The modular sink system of claim 9, further comprising a faucet coupled to the rim.

11. The modular sink system of claim 1, further comprising a support bar coupled to a bottom surface of the rim of the sink basin in a position between the sink basin and a rear edge of the rim of the sink basin configured for positioning adjacent the back surface of a countertop.

12. The modular sink system of claim 11, wherein a width of the support bar across the bottom surface of the rim is substantially the same as a width of the sink basin.

* * * * *